US006850152B1

(12) United States Patent
Woodall et al.

(10) Patent No.: US 6,850,152 B1
(45) Date of Patent: Feb. 1, 2005

(54) NON-FLAMMABLE LAND AND SEA MARKER

(75) Inventors: Robert Woodall, Panama City, FL (US); Felipe Garcia, Panama City, FL (US); Greg Reitmeyer, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 44 days.

(21) Appl. No.: 10/457,699

(22) Filed: Jun. 9, 2003

(51) Int. Cl.[7] ..... H05B 41/00

(52) U.S. Cl. ..... 340/332; 340/946; 340/984; 441/6; 441/11; 441/13; 441/20

(58) Field of Search ..... 340/332, 980, 340/908.1, 946, 952–956, 984; 441/6, 7, 11, 13, 20

(56) References Cited

U.S. PATENT DOCUMENTS 5,245,943 A * 9/1993 Hull et al. ..... 116/202
5,902,163 A * 5/1999 Baruzzi et al. ..... 441/23
6,013,985 A * 1/2000 Green et al. ..... 315/149
6,075,322 A * 6/2000 Pauly ..... 315/127
6,109,754 A * 8/2000 Steele ..... 359/522
6,195,039 B1 * 2/2001 Glass, Jr. ..... 342/357.09
6,203,390 B1 * 3/2001 Elliott ..... 441/80
6,412,482 B1 * 7/2002 Rowe ..... 128/204.18

* cited by examiner

*Primary Examiner*—Daryl C. Pope
(74) *Attorney, Agent, or Firm*—Donald G. Peck; James T. Shepherd

(57) ABSTRACT

A flameless and smokeless marker attracts attention to a site. A battery and electronics section has a battery module and electronics module. The battery module connects power to the electronics module for creating responsive power-activation signals. An inflatable bag section is connected to the battery and electronics section and has an inflator and flexible bag. The flexible bag is metalized to reflect radar signals and has ChLCD strips receiving the power-activation signals to be visible to radiation from a remotely located search beacon. A beacon section connected to the battery and electronics section and inflatable bag section has IR laser diode arrays arranged in a circular pattern and a strobe light. The IR laser diode arrays and strobe light are coupled to receive the power-activation signals from the battery and electronics section to emit IR radiation and visible radiation, respectively.

14 Claims, 3 Drawing Sheets

NON-FLAMMABLE LAND AND SEA MARKER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to location markers. More particularly, this invention is a long-lasting, effective marker that does not emit flame or smoke and may be activated during designated intervals to aid searchers find a specific location on land or at sea.

Markers have been used to designate or draw attention to a particular object or location on land and open water. Most, if not all emit relatively large flames and volumes of smoke to attract attention.

For example, one marker in inventory by some navies of the world has been designated the Mk 58 Mod 1 marine location marker which is designed for day or night use in any condition calling for long-burning smoke and flame reference point marking on the ocean's surface. It usually is used for antisubmarine warfare, but can be used for search-and-rescue operations, man-overboard markings, and as a target for practice bombing at sea. The marker produces a yellow flame and white smoke for a minimum of forty minutes and a maximum of sixty minutes. It is visible for at least three miles under normal operating conditions.

The Mk 58 Mod 1 marine location marker consists of a cylindrical tin can approximately 21.78 inches long and 5.03 inches in diameter. The can contains two pyrotechnic candles of a red phosphorus composition. The ignition end of the marker has three holes-two for smoke and flame emission and one for water to enter the Mk 72 Mod 1 seawater-activated battery. Adhesive foil disks hermetically seal the two emission holes. A reinforced adhesive foil strip with a rectangular pull ring hermetically seals the battery cavity hole. The adhesive foil seals are protected during handling and shipping by a replaceable polyethylene protective cover.

Other examples of contemporary markers are the Mk 25 Mod 2 and 3 marine location markers that are launched from aircraft or surface craft. They are launched from aircraft to provide day or night reference points for marking the course of enemy submarines in antisubmarine warfare operations. They are suitable for any type of sea-surface reference-point marking that calls for both smoke and flame for a period of 10 to 20 minutes. Mk 25 Mod 2 and 3 function identically. The only significant difference is that Mk 25 Mod 2 contains two seawater-activated batteries and two related squibs, while Mod 3 contains a single battery and a single squib.

The Mk 25 marker consists of a cylindrical outer tube about 18.5 inches long and 2.9 inches in diameter. A valve assembly is fitted into the projecting chimney at the marker's nose end. The smoke and flame are emitted from this opening. At the opposite end is a heavier aluminum base assembly to which the outer tube is crimped. The heavy base end causes the marker to float in the water with the chimney out of the water and the base in the water. Within the base assembly is a Mk 72 Mod 0 seawater-activated battery (two batteries in the Mod 2). The battery is shielded from water contact by two plugs fitted into ½-inch holes on two opposite sides of the base assembly. A rigid cover, or arming plate held in place by a retainer ring, is recessed into the base end. An arrow in the center of the arming plate indicates its safe or armed position. The words SAFE and ARMED are stamped into the base rim. Also, a machined notch in the rim at the armed position helps during night use. When the arming plate is in the safe position, it physically blocks the base plugs internally to prevent them from being accidentally pushed in. When in the armed position, the arming plate no longer blocks the base plugs, allowing them to be pushed in at the appropriate time. A black rubber O-ring circles the base assembly approximately ¼ inch from the crimp, which holds the outer case. To activate the seawater battery, the base plugs are pushed in before the marker is actually launched. An electric squib ignites the marker, and the seawater-activated battery (two batteries and two squibs in Mod 2) supplies power. When the marker enters the water, seawater enters the battery cavity and serves as an electrolyte, causing the battery to produce a current that activates the squib. The squib ignites the starter mix, which, in turn, ignites the red phosphorous pyrotechnic composition.

Gas buildup forces the valve assembly from the chimney in the nose, and yellow flame and white smoke are emitted. Burning time averages 13.5 to 18.5 minutes. Although this marker is normally used in seawater, it can be used in inland bodies of fresh water by using table salt.

Thus, in accordance with this inventive concept, a need has been recognized in the state of the art for a long-lasting, effective marker that does not emit flame or smoke and may be activated at designated times to aid searchers find a specific location on land or at sea.

OBJECTS AND SUMMARY OF THE INVENTION

An object of the invention is to provide a marker for use on land or at sea to attract attention without generating flame or smoke.

Another object of the invention is to provide a cost-effective marker to that does not rely on volumes of flame or smoke to attract attention.

Another object of the invention is to provide a marker not generating a large flame to enable its use on shipwrecks containing floating flammable liquids or on land sites near flammables or near planes, helicopters, or landing crafts.

Another object of the invention is to provide a marker having an extended operational capability in excess of sixty minutes.

Another object of the invention is to provide a marker that does not create a large smoke plume that would otherwise generate oxygen-depriving noxious compounds and obscure visibility at a place where operational visual awareness is a critical commodity.

Another object of the invention is to provide a marker that can be activated at designated times to be compatible with a network-centric electronic battlefield that requires precise operational timing of lane marking events with remote command & control capabilities to effect full reprogramming of a mission.

Another object of the invention is to provide a marker that solves the problem of the blooming effect associated with the use of cholesteric light-panel technology to allow the use of night vision goggles (NVGs) without blooming caused by a light source.

Another object of the invention is to provide a marker using reflective displays set in a flexible polyester substrate to allow the packaging of a large inflatable light source structure in a small container.

Another object of the invention is to provide a marker having a capability for providing short and long-range detection of an infrared signal/beacon by using NVGs and under adverse weather conditions by using arrays of pulsed infrared laser diodes.

Another object of the invention is to provide a marker using NVGs and arrays of pulsed infrared laser diodes operating in the portion of the infrared spectrum that does not cause NVG blooming.

Another object of the invention is to provide a marker using infrared laser diodes in conjunction with cholesteric displays to provide a balanced approach to trade-off short versus long-range visibility (detectability) versus power consumption.

Another object of the invention is to provide a marker having at least one array of pulsed infrared laser diodes that uses a photocell device to turn itself on/off at dusk/dawn.

Another object of the invention is to provide a marker using a self-contained clear lens covering a visual/daytime light-beacon strobe light that uses a photocell device to turn itself on/off at dawn/dusk.

Another object of the invention is to provide a marker using a radar-beam reflecting inflatable-structure that is covered in a sectional/segmented manner with reflective flexible cholesteric light-panels.

Another object of the invention is to provide a marker providing a self-scuttling capability with user selected operational time and using a simple electronic circuit clock to delay the opening of a scuttling valve.

Another object of the invention is to provide a marker providing a self-scuttling capability after deployment and sensing removal of a safety pin and a safety lanyard to assure opening of a scuttling valve by an electronic circuit clock in accordance with the user selected operational time and delays.

These and other objects of the invention will become more readily apparent from the ensuing specification when taken in conjunction with the appended claims.

Accordingly, the present invention is to a marker for attracting attention to a designated site or location. A battery and electronics section has a battery module and electronics module having a computer. The battery module connects power to the electronics module for creating responsive power-activation signals. An inflatable bag section is connected to the battery and electronics section and has an inflator and flexible bag. The flexible bag is at least partially metalized to reflect radar signals and has cholesteric liquid crystal display strips. The strips are connected to receive the power-activation signals from the battery and electronics section and are made visible to radiation from a remotely located search beacon. A beacon section is connected to the battery and electronics section and the inflatable bag section. The beacon section has IR laser diode arrays arranged in a circular pattern and a strobe light. The IR laser diode arrays and strobe light are coupled to receive the power-activation signals from the battery and electronics section to emit IR radiation and to emit visible radiation, respectively. A sealed, dome-shaped transparent cap of the beacon section covers the circular IR laser diode arrays and strobe light and supports the circular IR laser diode arrays. An RF antenna is embedded in the transparent cap and is connected to the battery and electronics section to receive and pass remotely originating RF control signals to the electronics module. A user control panel assembly is connected to the battery and electronics section and has controls for presetting the operation of the cholesteric liquid crystal display strips, the IR laser diode arrays, and the strobe light prior to deployment. A safety lanyard is connected to the electronics module for inhibiting generation of the power-activation signals and a ball-lock safety pin is connected to the inflator for inhibiting inflation of the flexible bag. A scuttling device is connected to the electronics module to create an opening for flooding in water.

DESCRIPTION OF THE PREFERRED EMBODIMENTS

Figure 1:
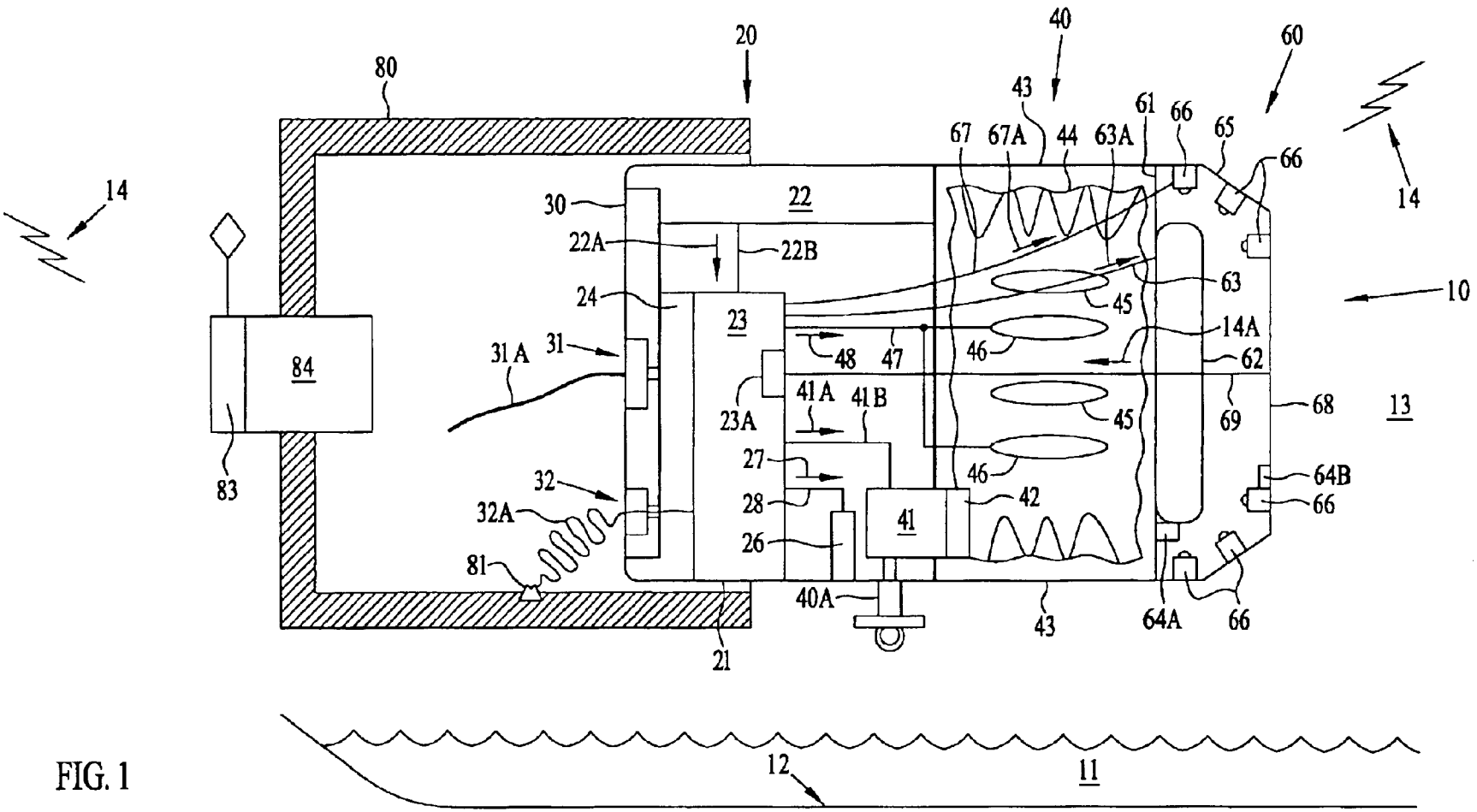
FIG. 1 is a schematic cross-sectional side view of the non-flammable land and sea marker of the invention prior to deployment.
Figure 2:
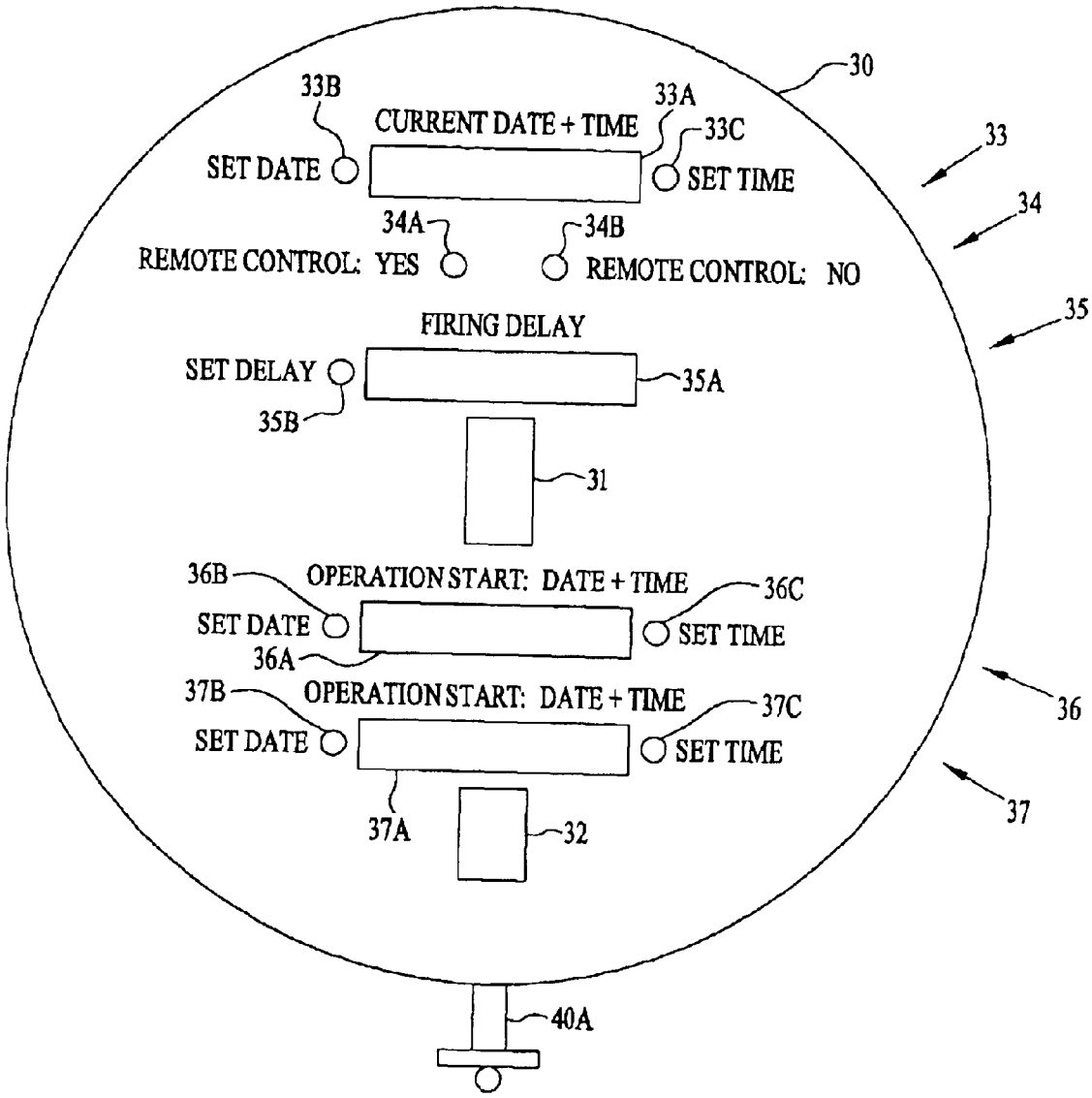
FIG. 2 is an end view of the marker showing the user control panel assembly for initiating predetermined intervals of activation.

Referring to FIGS. 1 and 2 of the drawings, non-flammable land and sea marker 10 of the invention is schematically depicted prior to deployment. Marker 10 can be used more universally and reliably as compared to many contemporary markers since marker 10 of the invention does not emit hazardous flames or plumes of dense smoke to attract attention. Marker 10 can be used to locate a particular site be it on water 11, land 12 or above in air 13.

Figure 3:
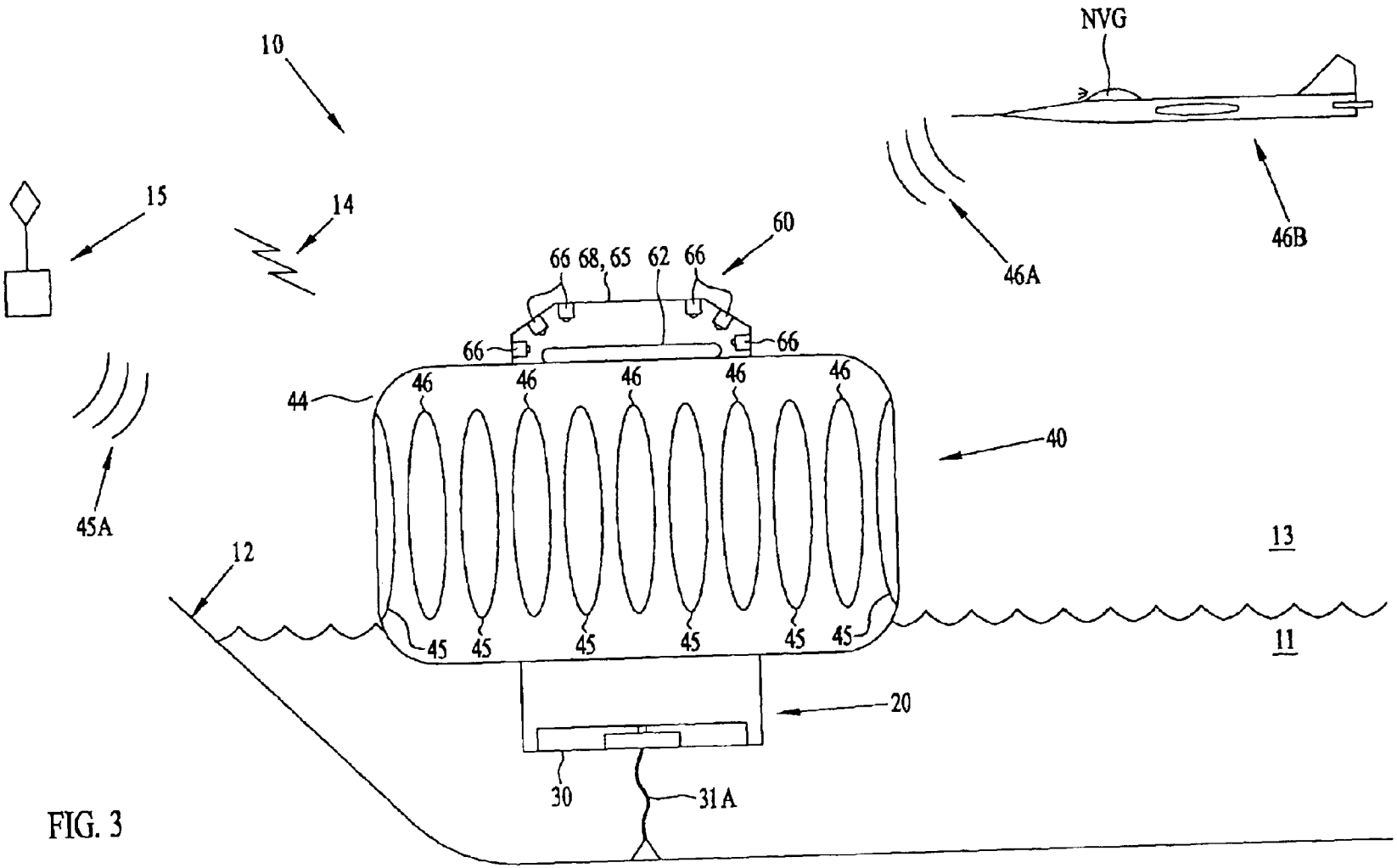
FIG. 3 is a partially cross-sectional view of marker of the invention that schematically shows the marker after deployment for drawing attention to its location.

Marker 10 has three interconnected sections: a battery and electronics section 20, an inflatable structure section 40 and a beacon section 60. These three sections 20, 40 and 60 are packaged together in a compact cylindrical shape measuring about fifteen inches in diameter that can be safely stowed for long periods of time in depots or onboard marine vessels or aircraft until marker 10 is needed to mark a designated site (location). Battery and electronics section 20 weighs more than inflatable structure section 40 and beacon section 60 This weight distribution holds beacon section 60 in air 13 above inflatable structure section 40 and water 11 when marker 10 is deployed and floats on water 11 as shown in FIG. 3.

Leads (to be described) for coupling power-activation signals and other signals (to be described) are schematically shown as being straight leads extending the shortest distance between associated components to avoid confusion in the drawings. It is understood that the leads would most likely be coiled arrangements having sufficient lengths to maintain electrical interconnections as marker 10 is inflated and deflated during deployment as explained below.

Battery and electronics section 20 has a water proof enclosure 21 that assures protection from environmental abuses and seals a battery module 22 from ambient water 11 and air 13. Battery module 22 couples power (shown as arrow 22A) over a lead 23B extending to an electronics module 23. Electronics module 22 may include a computer 24 that has appropriate software and operating instructions to transform the data of different inputted control signals to be described into selective power-activation signals to be described. The power-activation signals are coupled from electronics module 22 of battery and electronics section 20 to activate other components (to be described) that are mostly located in sections 40 and 60 to draw attention to the location of marker 10. Battery and electronics section 20 can additionally have a scuttling device 26 for creating an opening for some of water 11 to flood marker 10. Scuttling device 26 can be a valve mechanism or explosive controlled by power-activation signal. (shown as arrow 27) over lead 28 from electronics module 23 to flood or rupture marker 10 or otherwise make it non-retrievable (e.g. shattered or sunk) after its period of usefulness has ended.

A sealed user control panel assembly 30 is mounted on one side of enclosure 21 and is connected to battery and electronics section 20. Prior to deployment of marker 10 on water 11 or land 12, user control panel assembly 30 allows a deploying operator to preset an activation sequence of components of marker 10 or permit a desired activation sequence to be initiated by remotely originating RF control signals 14 from a remote command station 15. User control panel assembly 30 has an anchor point 31 (or loop) for an anchor line 31A for securing marker 10 in water 11 or on land 12.

User control panel assembly 30 has a safety lanyard port 32 that receives a safety lanyard 32A extending into electronics module 23. A ball-lock safety pin 40A extends through enclosure 21 of battery and electronics section 20 and is coupled to an electro-mechanical inflator 41 of inflatable structure section 40 that includes a pressurized gas cylinder 42. Inflator 41 can be activated (either inflating or deflating a flexible bag 44 of inflatable structure section 40) from electronics module 23 by power-activation signals (shown as arrow 41A) over an interconnecting lead 41B after safety pin 40A has been withdrawn.

When safety lanyard 32A is in place in safety lanyard port 32, generation of power-activation signals in electronics module 23 is inhibited (prevented) to prevent activation of inflator 41 and other components (to be described) of sections 40 and 60. When ball-lock safety pin 40A engages inflator 41, inflation of flexible bag 44 and consequent mechanical displacements of sections 40 and 60 of marker 10 are inhibited (prevented).

Referring to FIG. 2, in addition to anchor point 31 and safety lanyard port 32, user control panel assembly 30 has a current date/time set-control 33 with associated display 33A and control buttons 33B and 33C, remote-control yes button 34A and remote-control no button 34B, a delay firing-control 35 with associated display 35A and control button 35B, a date/time start-operation control 36 with associated display 36A and control buttons 36B, 36C, and a date/time, end-operation control 37 with associated display 37A and control buttons 37B, 37C.

Current date/time set control 33 is connected to computer 24 of electronics module 23 and is set by an operator to provide a starting or reference basis for future activation sequences, and remote-control-yes button 34A or remote-control-no buttons 345B can be selectively switched by an operator to control interconnected electronics module 23 and computer 24 to enable or disable a capability for activating some or all components of sections 40 and 60 of marker 10 by RF control signals 14 from remote source 15. Delay firing-control 35 can be preset by an operator to delay the activation of some or all components of marker 10. Start-operation control 36 and end-operation control 37 are connected to computer 24 and can be set by appropriately pushing buttons 36B, 36C and 37B, 37C to turn on and/or turn off some or all components of marker 10 at one or more intervals some time after deployment of marker 10. Displays 33A, 35A, 36A, and 37A can provide a visual indication for reference of current date/time and date/time of activations scheduled in user control panel assembly 30.

Inflatable structure section 40 has a frangible wall 43 containing a large and strong folded flexible thin-walled plastic bag 44 connected to inflator 41. Frangible wall 43 has sufficient strength and toughness to remain intact when marker 10 is deployed, but wall 43 shatters into many small pieces when bag 44 is rapidly inflated by pressurized gas (that may be lighter than air) vented from pressurized gas cylinder 42 of inflator 41. Flexible bag 44 can be made from a wide variety of flexible polyester substrate materials that are strong and air-tight to contain the pressurized gas. One typical flexible polyester material, for example, is the strong flexible thin film material marketed by Dupont Inc. under its trademark MYLAR. When marker 10 is deployed, folded bag 44 is inflated by pressurized gas from pressurized gas cylinder 42 of inflator 41. The force exerted by expanding bag 44 shatters frangible wall 43, and bag 44 is free to expand to its fully inflated size. The fully inflated size of inflated flexible bag 44 may be several times the diameter of inflatable structure section 40 of cylinder-shaped marker 10 prior to deployment and as schematically depicted in FIG. 3.

Flexible bag 44 can have its outer surface metalized entirely or in metalized strips 45 that can extend vertically from top to bottom around flexible bag 44 or extend in concentric ring-like configurations or any other patterns of disposition on flexible bag 44. This coverage of the outer surface assures reflection of impinging radar signals 45A to assure location of marker 10 from an airborne or land based radar (not shown).

Strips 46 (or panels) of cholesteric liquid crystal displays (ChLCDs) are disposed on flexible bag 44 to be held above water 11 when marker 10 is deployed to float on water 11. ChLCD strips 46 can be arranged to be interspersed or alternate with metalized strips 45 around bag 44. ChLCDS, such as those described in about thirty patents issued to Kent State University and/or Kent Displays Inc. of Kent Ohio, are well known. ChLCD strips 46 can exhibit high contrast due to the reflective nature of the cholesteric fluid. A display cell of ChLCD strip 46 can act as a collection of tiny mirrors, each reflecting 50% of incident light, or radiation. The total amount of light reflected by each cell is affected by the limited bandwidth, angular distribution of the mirrors, and depolarization of the light within the cell. This value can approach the reflectivity of ink on paper, with up to 70% peak reflectivity and a 20:1 contrast ratio.

Cholesteric materials can be formulated in ChLCDs strips 46 to be visible at night (or by day) by an observer remotely located from marker 10 that is using an infrared (IR) light source detector of radiation 46A such as an IR signal/beacon. One typical IR light source detector is known as night vision goggles (NVGs) that are worn over a wearer's eyes to detect radiated or reflected portions of IR light. ChLCD strips 46 give a reliable, relatively short range detection capability of marker 10 that is limited in range by the radiated power of radiation 46A of an IR search beacon. Radiation 46A of the IR search beacon is emitted from an air-born or water-born search platform 46B that can also have the remotely located observer wearing NGVs on board. ChLCDs strips 46 on marker 10 solves a problem known as the blooming effect.

The term blooming effect refers to a problem that has persisted over the years and degraded performance of night vision systems when a lighted object enters system's field of view. The lighted objects could be vehicles having headlights on, lighted flashlights or lasers entering an area, brightly lit buildings in an urban setting, and any type of directional or high intensity lighting that illuminates a night vision system. Image blooming occurs immediately which obscures the system's view of objects in the nighttime scene. As a result of the automatic gain control of the imaging tube of the system, the imaging tube saturates from the increased intensity of the bright lights to mask objects in the scene that is trying to be observed. This effect (image blooming) limits night vision system performance for surveillance, targeting, and piloting at night. The reflective cholesteric technology of ChLCD strips 46 allows the use of NVGs without being susceptible to the blooming effect described above that might otherwise be caused by a radiating light source such as a strobe light 62 on maker 10, for example. Thus, ChLCDs strips 46 can preserve the covertness of stealth missions or augment vision capability of observers using NVGs to enhance the range/detectability of a signal/beacon of marker 10. Within the illuminating range of the IR search beacon, ChLCDs strips 46 can provide brightest reflective displays with the lowest power consumption.

ChLCD strips 46 are connected to electronics module 23 of section 20 by an activation lead 47. Activation lead 47 transmits power-activation signals (shown as arrow 48) for activation of ChLCD strips 46 to enable detection by a remote observer using NVGs for example from selective IR beacon radiation 46A that impinges on inflated bag 44 of section 40.

Beacon and RF antenna section 60 has a base member 61 supporting a strobe light 62 and a sealed, dome-shaped transparent cap 65. Cap 65 that covers and supports three circular arrays 66 of IR laser diodes, and an RF antenna 68 is embedded in cap 65. Leads 63 and 67 extend from strobe light 62 and IR laser diode arrays 66 to respectively couple power-activation signals (shown as arrows 63A, and 67A) from electronics module 23. Lead 69 extends from embedded RF antenna 68 to receiver circuitry 23A in electronics module 23 to receive and couple remotely originating RF control signals (shown as arrow 14A on lead 69 in FIG. 1) transmitted from a remote craft or command station 15 to electronics module 23.

The information of remotely originating RF control signals 14 is coupled to receiver circuitry 23A of electronics module 23 to generate and couple responsive power-activation signals 41A, 48 63A, 67A, and 27 over leads 41B, 47, 63, 67, and 28 respectively, and remote control of inflator 41 for inflation and/or deflation of bag 44, and activation of ChLCD strips 46, strobe light 62, IR diode arrays 66, and scuttling device 26. This actuation capability augments the selective actuation of inflator 41, ChLCD strips 46, strobe light 62, IR laser diode arrays 66 and scuttling device 26 by user control panel assembly 30 and electronics module 23 with computer 24. In addition, photodiodes 64A and 64B can be respectively connected to electronics module 23 and strobe light 62 and/or IR laser diode arrays 66 via leads 63 and 67 to automatically switch or turn strobe light 62 and/or IR laser diode arrays 66 on or off at dawn or dusk.

IR laser diode arrays 66 of marker 10 provide a capability for long-range detection by operators wearing NVGs. Pulsing IR laser diode arrays 66 emit an infrared signal/beacon that can be effective under adverse weather conditions. The IR laser diodes of arrays 66 operate or emit IR energy in a portion of the IR spectrum that does not cause blooming in the NVGs. IR laser diode arrays 66 provide a longer range detectability of marker 10 as compared to the detectability of ChLCD strips 46 to give a capability for both long rang and short range detection and provide a balanced approach to tradeoff short-versus-long-range visibility versus power consumption.

In operation, marker 10 has options to accommodate a wide variety of contingencies and tactical scenarios. When marker 10 is to be manually deployed at its intended site of operation, an operator can press yes-remote-control button 34A or no-remote-control button 34B of user control panel assembly 30 as desired to use or not use the option for actuation of marker 10 by remotely originating RF control signals 14 that are received by embedded RF antenna 69. The operator can also appropriately set date/time set control 33, firing delay control 35, operation start date/time control 36 and operation end date/time control 37 of user control panel assembly 30 for appropriate control signals for a desired activation of constituents of marker 10. The operator then pulls ball-lock safety pin 40A from inflator 41 to allow venting of pressurized gas from pressurized gas container 42 into flexible bag 44. so that flexible bag 44 can expand and break frangible wall 43 as it mechanically displaces sections 40 and 60 of marker 10. Nearly simultaneously, the operator pulls safety lanyard 32A from lanyard port 32, and electronics module 23 with computer 24 generates appropriate power-activation signals to initiate an activation sequence of some or all of ChLCD strips 46, strobe light 62 and/or IR laser diode arrays 66 of marker 10. ChLCD strips 46 reduce power drain since the y do not require continuous power. In other words, Once ChLCD strips 46 are energized, or activated, (i.e., once the desired information is displayed) ChLCD strips 46 stay that way indefinitely (i.e., the displayed information continuous to be displayed without the need for a power source or subsequent input like a chalkboard that keeps information written on it). The activated components and activation sequence can be predetermined in computer 24 of electronics module 23 or in accordance with the settings as just initiated by the deploying operator.

When marker 10 is to be remotely operated, controls 33, 34, 35, 36, and 37 of user control panel assembly 30 can be preset as described, and marker 10 is manually loaded into its can-shaped external marker dispenser 80 that can be remotely operated, see FIG. 1. Safety lanyard 32A is manually connected to a spur 81 inside of marker dispenser 80. The operator manually removes ball-lock safety pin 40*a* and manually secures marker 10 to marker dispenser 80 by fitting marker 10 within it. (Marker 10 is shown in FIG. 1 as being only partially within dispenser 80.) Marker 10 can be remotely ejected from dispenser 80 by a variety of means, such as by receiving RF control signals 14 at a receiver 83 that initiates an ejection mechanism 84. Ejection mechanism 84 can cause release of a compressed spring (not shown) or detonation of an explosive charge (not shown) etc. to eject marker 10 out of dispenser 80. This remote ejection of marker 10 leaves safety lanyard 32A attached to dispenser 80 and pulled from electronics module 23.

Pulling or extraction of safety lanyard 32A from electronics module 23 causes electronics module 23 of section 20 to electrically disable by circuit-disconnection date/time set control 33, remote control yes button 34A and remote control no button 34B, and delay firing-control 35 of user control panel assembly 30. Safety lanyard 32A is pulled from electronics module 23 to preclude water impact or unauthorized users from changing the mode of operation of marker 10. After safety lanyard 32A has been extracted, full command & control of marker 10 can be done using the remote control option by pressing remote-control-yes button 34A before ejection of marker 10.

When the set remote control option was set as "remote control: yes" by switching remote-control-yes button 34A, electronics module 23 couples power to remote control circuit associated with control button 34A. This provides an RF link to RF signal receiver circuitry 23A in electronics module 23 via lead 69 and embedded RF antenna 68. Remote control of marker 10 via RF control signals 14 can now be done as if the remote operator were actually present in marker 10. Selective ones of inflator 41, ChLCD strips 46, and strobe light 62, and IR laser diode arrays 66 can be turned on and off by appropriate power-activation signals created as directed by appropriate RF control signals 14. Scuttling device 26 could be actuated by RF control signals 14 as well.

When the set firing delay-time option is used to delay activation of some or all of the constituents of marker 10 until a future time, delay firing-control 35 is set by appropriately pressing set delay button 35B to indicate the desired delay on display 35A. Electronics module 23 now can electrically enable delay firing control 35 by circuit-connection of power from battery module 22 to delay firing control 35. Control 35 and electronics module 23 count down the selected firing delay-time, and electronics module 23 sends power-activation signal 41A over lead 41B to inflator 41 that causes inflation (or in some actuation sequences deflation) of flexible bag 44. Electronics module 23 can also activate ChLCD strips 46 by sending circuit-connection power to them as power-activation signals 48 in response to control signals from control 35, enable strobe light 62 by circuit-connection of power-activation signals 63A to it (with built-in photo cell 64A), and enable IR laser diode arrays 66 by circuit-connection of power-activation signals 67A to them (with built-in photo cell 64B).

When the set operation start date/time option is used to start activation of some or all of the constituents of marker 10 at a future time, then date/time start-operation control 36 is set by appropriately pushing set date and set time buttons 36B, 36Cs to the desired date and time that is shown on display 36A. Electronic module 23 now can electrically enable date/time start-operation control 36 by circuit-connection of power from battery module 22 to date/time start-operation control 36. Control 36 and electronics module 23 begin to count down to the selected time and date to create and send power-activation signals in response to control signals from control 36 for activation of selected constituents of marker 10. These constituents can include inflator 41, ChLCD strips 46, strobe light 62, and IR laser diode arrays 66 as described above.

When the set operation end date/time option is used to end activation of some or all the constituents of marker 10 at a future time, then date/time end-operation control 37 is set by appropriately pushing set date and set time buttons 37B, 37Cs to the desired date and time that is shown on display 37A. Electronic module 23 now can electrically enable date/time end-operation control 37 by circuit-connection of power from battery module 22 to date/time end-operation control 37. Control 37 and electronics module 23 begin to count down to the selected time and date, and in response to control signals from control 37, electronics module 23 can send power-activation signal 41A over lead 41B to inflator 41 that causes deflation of flexible bag 44 or a power-activation signal 26 over lead 28 to scuttling device 26 to scuttle marker 10. Optionally, control 37 and electronics module 23 can also deactivate ChLCD strips 46 by interrupting power to them, disable strobe light 62 by interrupting power to it, and disable IR laser diode arrays 66 by interrupting power to them.

Marker 10 of the invention has an extended operational capability as compared to contemporary systems that are limited to no more than about sixty minutes. Marker 10 does not generate a flame or smoke plume whereas many contemporary markers create large smoke plumes of oxygen depriving noxious compounds that may affect victims and rescue personnel or obscure observation at a place where operational visual awareness is a critical commodity. The design of other state-of-the art marker systems generates a large flame plume, and consequently requires complicated features to ensure safe use, resulting in increased cost and decreased operational capabilities. In addition, contrary to state-of-the-art marker systems, marker 10 can be made compatible with a network-centric electronic battlefield that requires precise operational timing of lane marking events and has remote command & control capabilities to effect full reprogramming of a mission.

Having the teachings of this invention in mind, modifications and alternate embodiments of marker 10 may be adapted without departing from the scope of the invention. Marker 10 could have different combinations of attention-getting displays without resorting to flame and smoke of contemporary marker systems. Marker 10 has long shelf life and is in a compact package for accompanying rapidly moving forces until needed.

The disclosed components and their arrangements as disclosed herein, all contribute to the novel features of this invention. Marker 10 provides for location of a designated site without relying on the flames and smoke of contemporary markers that might otherwise compromise its effectiveness and a possibly covert marking of a designated site for successful completion of tasks. Therefore, marker 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

We claim:

1. A marker for attracting attention to a site comprising:

a battery and electronics section having a battery module and an electronics module having a computer, said battery module connecting power to said electronics module for creating power-activation signals;

an inflatable bag section connected to said battery and electronics section having an inflator and flexible bag, said flexible bag being at least partially metalized to reflect radar signals and having cholesteric liquid crystal display strips connected to receive said power-activation signals from said battery and electronics section, said power activation signals making said strips visible to radiation from a remotely located search beacon of said radiation; and a beacon section connected to said battery and electronics section and said inflatable bag section, said beacon section having IR laser diode arrays arranged in a circular pattern and a strobe light, said IR laser diode arrays and strobe light being coupled to receive said power-activation signals from said battery and electronics section to emit IR radiation and to emit visible radiation, respectively.

2. The marker of claim 1 further comprising:

a sealed, dome-shaped transparent cap of said beacon section covering said circular IR laser diode arrays and said strobe light and supporting said circular IR laser diode arrays; and an RF antenna embedded in said transparent cap, said RF antenna being connected to said battery and electronics section to generate responsive power-activation signals by remotely originating RF control signals.

3. The marker of claim 2 further comprising:

a user control panel assembly connected to said battery and electronics section having controls for presetting operation of said cholesteric liquid crystal display strips, said IR laser diode arrays, and said strobe light prior to deployment.

4. The marker of claim 2 further comprising:

a safety lanyard connected to said electronics module for inhibiting generation of said power-activation signals and a ball-lock safety pin connected to said inflator for inhibiting inflation of said flexible bag.

5. The marker of claim 4 further comprising:

a scuttling device connected to said electronics module to create an opening for flooding in water.

6. The marker of claim 5 further comprising:

photodiodes connected to said electronics module, strobe light and IR laser diode arrays to switch said strobe light and IR laser diode arrays at dawn and dusk.

7. The marker of claim 6 wherein said controls of said user control panel assembly include a current date/time set-control with associated display and control buttons, remote-control-yes button and remote-control-no button, a delay firing-control with associated display and control button, a date/time start-operation control with associated display and control buttons, and a date/time, end-operation control with associated display and control buttons.

8. The marker of claim 7 wherein said safety lanyard connected to said electronics module extends through said user control panel assembly, and said user control panel assembly is provided with an anchor point to receive an anchoring line.

9. The marker of claim 8 wherein said battery and electronics section weighs more than said inflatable structure section and said beacon section to hold said beacon section above said inflatable structure section during deployment on said water.

10. The marker of claim 9 wherein said inflator, said cholesteric liquid crystal display strips, strobe light, IR diode arrays, and scuttling device are responsive to said power-activation signals.

11. The marker of claim 10 wherein switching said remote-control yes button provides an RF link to RF signal receiver circuitry in said electronics module via a lead to allow activation of selective ones of said inflator, said cholesteric liquid crystal display strips, said strobe light, said IR laser diode arrays and said scuttling device by appropriate power-activation signals created by appropriate RF control signals.

12. The marker of claim 11 wherein switching said delay firing-control delays activation to a future date and time set by appropriately pressing a set delay button to indicate the desired delay on a delay display and enables a count down by said electronics module to the selected firing delay-time, said electronics module sends power-activation signals over leads to allow activation of selective ones of said inflator, said cholesteric liquid crystal display strips, said strobe light, said IR laser diode arrays and said scuttling device.

13. The marker of claim 12 wherein switching buttons of said date/time start operation control starts activation at a desired date and time shown on a display and enables said electronics module to count down to the desired time and date to create and send power-activation signals for activation of selected ones of said inflator, said cholesteric liquid crystal display strips, said strobe light, said IR laser diode arrays and said scuttling device.

14. The marker of claim 13 wherein switching buttons of said date/time end operation control ends activation at a desired date and time shown on a display and enables said electronics module to count down to the desired time and date to create and send power-activation signals to said inflator to deflate said flexible bag, to said scuttling device to scuttle said marker, to deactivate said cholesteric liquid crystal display strips by interrupting power to them, to disable strobe light by interrupting power to it, and disable IR laser diode arrays by interrupting power to them.

* * * * *